US009347345B2

(12) United States Patent
Spix et al.

(10) Patent No.: US 9,347,345 B2
(45) Date of Patent: May 24, 2016

(54) INTERNAL COMBUSTION ENGINES AND OIL CONTAINMENT SYSTEMS THEREOF

(71) Applicant: GM GLOBAL TECHNOLOGY OPERATIONS LLC, Detroit, MI (US)

(72) Inventors: Thomas A. Spix, Rochester Hills, MI (US); Christopher Paul Nelander, West Bloomfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 127 days.

(21) Appl. No.: 13/645,753

(22) Filed: Oct. 5, 2012

(65) Prior Publication Data

US 2014/0096737 A1 Apr. 10, 2014

(51) Int. Cl.
*F01M 13/04* (2006.01)
*F01M 11/04* (2006.01)

(52) U.S. Cl.
CPC ..... *F01M 11/0458* (2013.01); *F01M 13/0416* (2013.01); *F01M 2011/0466* (2013.01); *F01M 2013/0433* (2013.01)

(58) Field of Classification Search
CPC ..... F01M 13/0416; F01M 13/0405; F01M 11/04; F01M 11/0458; F02F 7/006
USPC ..... 123/196 R
See application file for complete search history.

(56) References Cited

U.S. PATENT DOCUMENTS

| | | | | |
|---|---|---|---|---|
| 5,129,371 | A * | 7/1992 | Rosalik, Jr. | F01M 13/0416 123/41.86 |
| 5,228,420 | A * | 7/1993 | Furuya et al. | 123/90.38 |
| 5,323,740 | A * | 6/1994 | Daily et al. | 123/90.38 |
| 5,630,451 | A | 5/1997 | Bernard | |
| 5,944,001 | A * | 8/1999 | Hutchins | 123/572 |
| 8,016,904 | B2 * | 9/2011 | Gwin et al. | 55/385.4 |
| 8,065,993 | B2 | 11/2011 | Festag et al. | |

FOREIGN PATENT DOCUMENTS

| | | | |
|---|---|---|---|
| CN | 202081999 | U | 12/2011 |
| JP | H0683912 | U | 12/1994 |
| JP | 2007092637 | A | 4/2007 |

* cited by examiner

*Primary Examiner* — Stephen K Cronin
*Assistant Examiner* — Kevin Lathers
(74) *Attorney, Agent, or Firm* — Quinn Law Group, PLLC

(57) ABSTRACT

An internal combustion engine includes an engine assembly and an oil containment system attachable to the assembly. The oil containment system includes a cover component including an oil fill apparatus configured for conducting an oil to the internal combustion engine. The apparatus has a first end sealable with a cap, a second end spaced apart from the first end along a central longitudinal axis, and an annular wall concentric with and extending along the central longitudinal axis. The annular wall defines a first passage therethrough and a channel extending through the cover component along the central longitudinal axis. The oil containment system also includes a baffle component abutting the second end and defining a second passage therethrough such that the second passage is spaced apart from the channel.

14 Claims, 2 Drawing Sheets

INTERNAL COMBUSTION ENGINES AND OIL CONTAINMENT SYSTEMS THEREOF

TECHNICAL FIELD

The disclosure relates to internal combustion engines, and more specifically, to oil containment systems for internal combustion engines.

BACKGROUND

Internal combustion engines are often lubricated by an oil that circulates within the internal combustion engine. As such, the oil may lubricate moving components of the internal combustion engine, dissipate thermal energy generated during operation of the internal combustion engine, and protect against premature wear of the internal combustion engine.

SUMMARY

An internal combustion engine includes an engine assembly and an oil containment system attachable to the engine assembly. The oil containment system includes a cover component including an oil fill apparatus configured for conducting an oil to the internal combustion engine. The oil fill apparatus includes a first end sealable with a cap, a second end spaced apart from the first end along a central longitudinal axis, and an annular wall concentric with and extending along the central longitudinal axis. The annular wall defines a first passage therethrough, and a channel extending through the cover component along the central longitudinal axis. Further, the oil containment system also includes a baffle component abutting the second end and defining a second passage therethrough such that the second passage is spaced apart from the channel.

In one embodiment, the engine assembly defines four cylinder bores therein. The internal combustion engine also includes four pistons each configured for reciprocating within a respective one of the four cylinder bores between a first position and a second position to thereby collectively displace a quantity of air having a first volume from the engine assembly. In addition, the internal combustion engine includes an oil circulatable within the internal combustion engine, and an oil containment system attachable to the engine assembly. The oil containment system includes a cover component including an oil fill apparatus configured for conducting the oil to the internal combustion engine. The oil fill apparatus has a first end sealable with a cap, a second end spaced apart from the first end along a central longitudinal axis, and an annular wall concentric with and extending along the central longitudinal axis. The annular wall defines a first passage therethrough, and a channel extending through the cover component along the central longitudinal axis. Further, the oil containment system includes a baffle component abutting the second end and defining a second passage therethrough such that the second passage is spaced apart from the channel. The oil fill apparatus is configured to direct the oil from the channel to the second passage through the first passage. Further, the baffle component and the cover component together define a capture cavity between the first passage and the second passage. The capture cavity has a second volume that is greater than the first volume.

An oil containment system for an internal combustion engine includes a cover component including an oil fill apparatus configured for conducting an oil to the internal combustion engine. The oil fill apparatus has a first end sealable with a cap, a second end spaced apart from the first end along a central longitudinal axis, and an annular wall concentric with and extending along the central longitudinal axis. The annular wall defines a first passage therethrough, and a channel extending through the cover component along the central longitudinal axis. In addition, the oil containment system includes a baffle component abutting the second end and defining a second passage therethrough such that the second passage is spaced apart from the channel.

The detailed description and the drawings or Figures are supportive and descriptive of the disclosure, but the scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Figure 1:
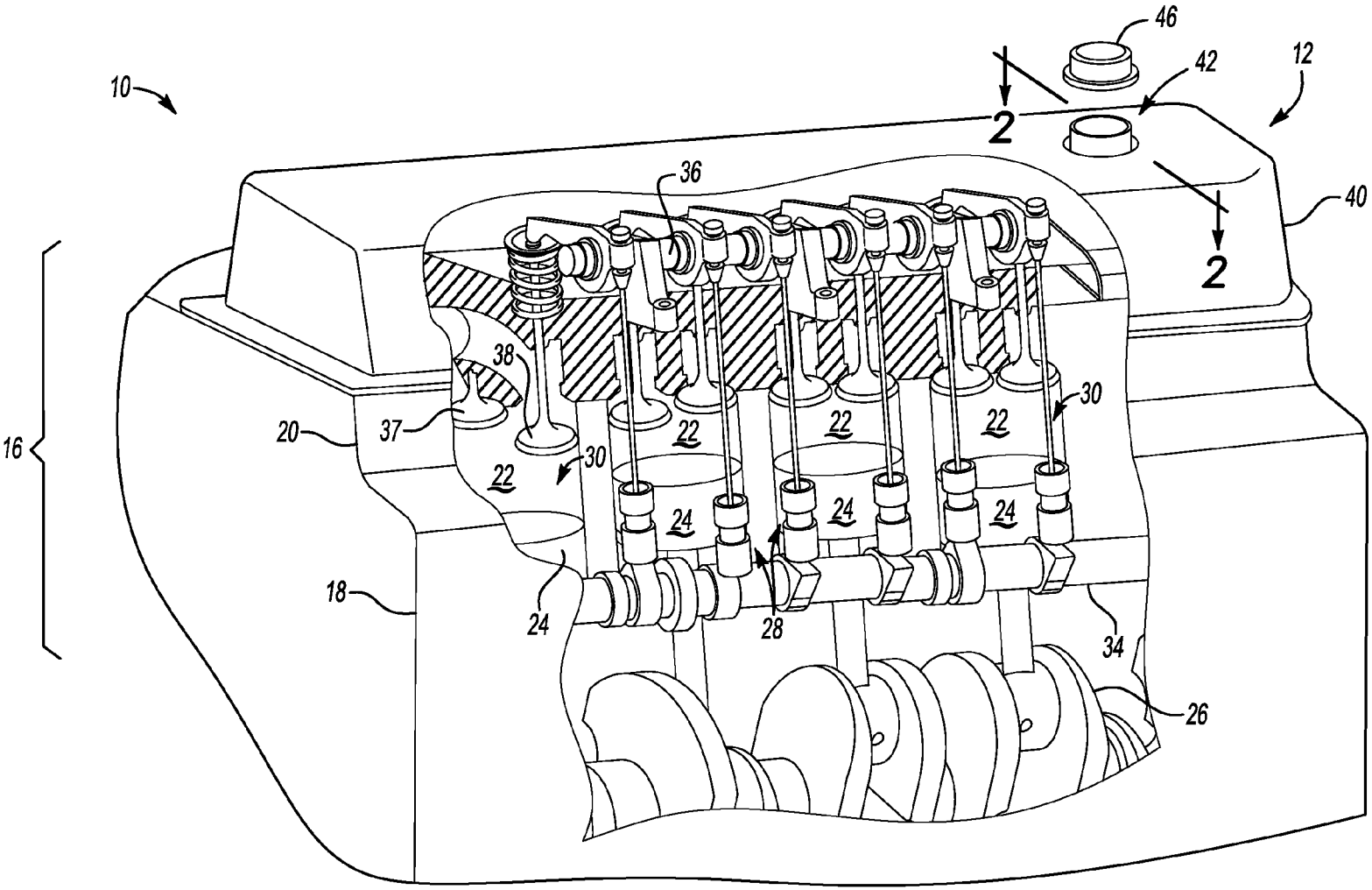
FIG. 1 is a schematic perspective illustration of a partial cutaway view of an internal combustion engine including an oil containment system.

Referring to the Figures, wherein like reference numerals refer to like elements, an internal combustion engine 10 including an oil containment system 12 is shown generally in FIG. 1. The internal combustion engine 10 and oil containment system 12 may be useful for vehicles, such as automotive vehicles, that may require separation of an oil 14 (FIG. 2) from an air-oil mixture generated during operation of the internal combustion engine 10. However, the internal combustion engine 10 and oil containment system 12 may also be useful for non-automotive applications including, for example, marine and aviation applications.

Referring now to FIG. 1, the internal combustion engine 10 includes an engine assembly 16. The engine assembly 16 may include a cylinder block (shown generally at 18) and a cylinder head (shown generally at 20) sealingly mated to the cylinder block 18. For example, the engine assembly 16 may include a head gasket (not shown) configured to seal the cylinder head 20 to the cylinder block 18.

Further, with continued reference to FIG. 1, the engine assembly 16 may define a plurality of cylinder bores 22 therein each configured to receive a respective one of a plurality of pistons (shown generally at 24). For example, the engine assembly 16 may be a 4-cylinder, 6-cylinder, 8-cylinder, or 12-cylinder internal combustion engine, and as such, may respectively define four, six, eight, or twelve cylinder bores 22 therein. Further, the internal combustion engine 10 may be configured to consume a fuel (not shown) such as, but not limited to, gasoline, ethanol, diesel, and combinations thereof.

Generally, as shown in FIG. 1, the internal combustion engine 10 may include the same number of pistons 24 as cylinder bores 22 so that one piston 24 is disposed within each cylinder bore 22. Further, the internal combustion engine 10 may include a crankshaft 26, and each piston 24 may be attached to the crankshaft 26.

As best shown in FIG. 1, in one embodiment, the engine assembly 16 may define four cylinder bores 22 therein. That is, the cylinder block 18 and the cylinder head 20 may together define the four cylinder bores 22 so that the internal combustion engine 10 is a 4-cylinder internal combustion engine. The four cylinder bores 22 may have a generally cylindrical shape, and may be configured for receiving a respective one of the plurality of pistons 24 during combustion of the fuel.

In addition, with continued reference to FIG. 1, the pistons 24 and cylinder bores 22 of the internal combustion engine 10 may be lubricated by the oil 14 (FIG. 2) that is circulatable within the internal combustion engine 10. The oil 14 may circulate within the internal combustion engine 10 to lubricate moving pistons 24, dissipate thermal energy generated during operation of the internal combustion engine 10, and protect against premature wear and corrosion of ferrous components of the internal combustion engine 10.

Referring again to FIG. 1, each of the plurality of pistons 24 is configured for reciprocating within a respective one of the cylinder bores 22 between a first position (shown generally at 28) and a second position (shown generally at 30) to thereby collectively displace a quantity of air 32 (FIG. 2) having a first volume (denoted generally by shading 80 in FIG. 2) from the engine assembly 16. For example, the first position 28 may be characterized as "top dead center" and may refer to a position at which a top of the piston 24 is disposed farthest away from the crankshaft 26. Similarly, the second position 30 may be characterized as "bottom dead center" and may refer to a position at which the top of the piston 24 is disposed closest to the crankshaft 26. Therefore, as the plurality of pistons 24 reciprocate within the plurality of cylinder bores 22 between the first position 28 and the second position 30, the internal combustion engine 10 may "breathe" to displace the quantity of air 32 from the engine assembly 16.

Therefore, it is to be appreciated that for the embodiment wherein the engine assembly 16 defines four cylinder bores 22 therein, the internal combustion engine 10 also includes four pistons 24 each configured for reciprocating within a respective one of the four cylinder bores 22 between the first position 28 (FIG. 1) and the second position 30 (FIG. 1) to thereby collectively displace the quantity of air 32 (FIG. 2) having the first volume 80 (FIG. 2) from the engine assembly 16.

Referring again to FIG. 1, to optimize combustion of the fuel within the plurality of cylinder bores 22, the engine assembly 16 may also include one or more camshafts 34 and rocker shafts 36 each configured to drive one or more intake valves 37 and one or more exhaust valves 38. In particular, the one or more camshafts 34 and/or rocker shafts 36 may be arranged to selectively open and close the one or more intake valves 37 to allow an air-fuel mixture into each cylinder bore 22 before combustion, and to selectively open and close the one or more exhaust valves 38 to exhaust combustion products from each cylinder bore 22 after combustion. In one embodiment, the engine assembly 16 may include two camshafts 34 each disposed below the plurality of cylinder bores 22, and may include one intake valve 37 and one exhaust valve 38 per each piston 24. Alternatively, although not shown, the engine assembly 16 may include two camshafts 34 each disposed above or "overhead" of the plurality of cylinder bores 22.

Therefore, during operation of the internal combustion engine 10 (FIG. 1), hot gases (not shown) may be produced within each cylinder bore 22 as fuel is consumed. The hot gases may occupy comparatively more volume than the fuel before combustion, and may be contained by a volume of each cylinder bore 22. As such, pressure within the cylinder bore 22 may increase and may act upon a respective piston 24 to thereby move the crankshaft 26 so that the internal combustion engine 10 may convert linear motion of the piston 24 into rotational motion of the crankshaft 26. Therefore, the internal combustion engine 10 may power a vehicle (not shown).

Figure 2:
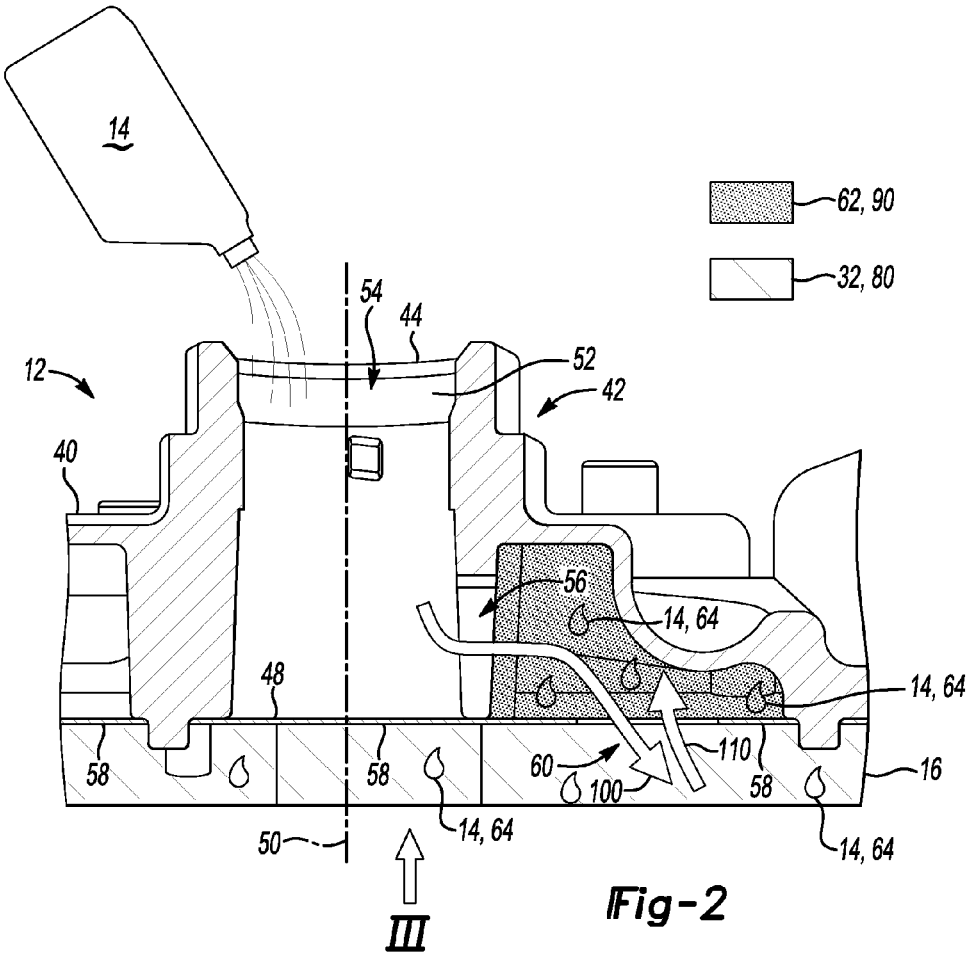
FIG. 2 is a schematic illustration of a cross-sectional view of the oil containment system of FIG. 1 taken along section lines 2-2.

Referring now to FIGS. 1 and 2, the internal combustion engine 10 also includes the oil containment system 12 attachable to the engine assembly 16. For example, the oil containment system 12 may be attachable to the engine assembly 16 at an upper portion of the engine assembly 16. More specifically, for the embodiment of the internal combustion engine 10 including one or more camshafts 34 and rocker shafts 36, the oil containment system 12 may be configured to cover the one or more rocker shafts 36 and sealingly mate with the cylinder head 20 (FIG. 1). As such, although not shown, the internal combustion engine 10 may include a gasket disposed between the oil containment system 12 and the engine assembly 16.

As best shown in FIG. 1, the oil containment system 12 includes a cover component 40 including an oil fill apparatus 42 configured for conducting the oil 14 (FIG. 2) to the internal combustion engine 10. The cover component 40 may be arranged to cover the engine assembly 16 and may be referred to, for example, as a cam cover, a crankcase casting, or a cam cover casting. As such, the cover component 40 may protect moving components of the internal combustion engine 10, such as the one or more rocker shafts 36. The cover component 40 may be formed from any material suitable for the operating conditions of the internal combustion engine 10, such as, but not limited to, a metal.

Referring now to FIG. 2, the oil fill apparatus 42 may receive and channel oil 14 into the internal combustion engine 10. That is, oil 14 may be added to the internal combustion engine 10 through the oil fill apparatus 42. More specifically, the oil fill apparatus 42 has a first end 44 sealable with a cap 46 (FIG. 1), a second end 48 spaced apart from the first end 44 along a central longitudinal axis 50, and an annular wall 52 concentric with and extending along the central longitudinal axis 50.

As best shown in FIG. 2, the annular wall 52 defines a channel 54 extending through the cover component 40 along the central longitudinal axis 50. As such, oil 14 may be poured into the channel 54 at the first end 44 so that the oil 14 may drain down the annular wall 52 towards the second end 48, and into the engine assembly 16.

Figure 3:
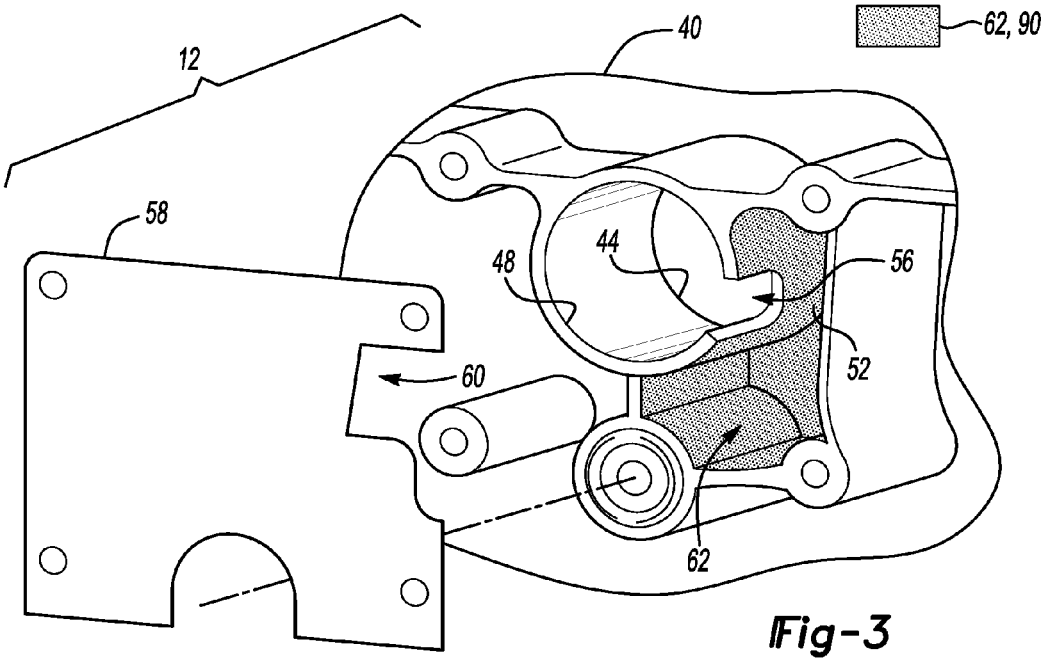
FIG. 3 is a schematic perspective illustration of an exploded view of the oil containment system of FIGS. 1 and 2 as viewed from position III.

In addition, with continued reference to FIG. 2, the annular wall 52 also defines a first passage 56 therethrough. The first passage 56 may have any shape, such as, for example, a half-moon or rectangular shape. Further, the first passage 56 may be configured to conduct the oil 14 through the annular wall 52, as set forth in more detail below. For example, as best shown in FIG. 3, in one embodiment, the annular wall 52 may define the first passage 56 through the second end 48. That is, the first passage 56 may form a cutout at the second end 48 of the oil fill apparatus 42. In another embodiment, although not shown, the annular wall 52 may define the first passage 56 between the first end 44 and the second end 48.

Referring again to FIG. 2, regardless of the shape or position of the first passage 56, the first passage 56 may be configured to drain from about 130 milliliters/second to about 160 milliliters/second therethrough. For example, the first passage 56 may drain from about 130 milliliters/second to about 150 milliliters/second, or about 140 milliliters/second, therethrough. As such, the first passage 56 may be sized to adequately drain oil 14 therethrough during filling of the internal combustion engine 10 (FIG. 1) with oil 14, or during maintenance operations that require a change of oil 14.

As best shown in FIG. 2, the oil containment system 12 also includes a baffle component 58 abutting the second end 48 of the oil fill apparatus 42. The baffle component 58 may direct oil 14 disposed within the channel 54 through the first passage 56 in the direction of arrow 100. That is, the baffle component 58 may generally close off the second end 48 and direct oil 14 within the channel 54 to the first passage 56. Stated differently, the baffle component 58 may seal the channel 54 at the second end 48. As such, the baffle component 58 may not define any opening therethrough that is disposed between the central longitudinal axis 50 and the annular wall 52 so that the oil 14 drains only through the first passage 56. The baffle component 58 may be attached to the cover component 40 in any manner. For example, although not shown, the baffle component 58 may be adhered and/or riveted to the cover component 40.

Further, as best shown in FIG. 2, the baffle component 58 defines a second passage 60 therethrough such that the second passage 60 is spaced apart from the channel 54. That is, the baffle component 58 may define the second passage 60 spaced apart from the channel 54 and the annular wall 52 such that the baffle component 58 seals off the channel 54 at the second end 48. Stated differently, the second passage 60 may be spaced apart from the first passage 56. However, as set forth in more detail below, the second passage 60 may be disposed in fluid communication with the first passage 56 so that oil 14 may drain from the channel 54, through the first passage 56, to the second passage 60, and on to the engine assembly 16 in the direction of arrow 100.

With continued reference to FIG. 2, the second passage 60 may have any suitable shape or configuration, such as, for example, generally-square as shown in FIG. 3. Further, the second passage 60 may be configured to drain from about 130 milliliters/second to about 160 milliliters/second therethrough. For example, the second passage 60 may drain from about 130 milliliters/second to about 150 milliliters/second, or about 140 milliliters/second, therethrough. As such, the second passage 60 may be sized to adequately drain oil 14 therethrough during filling of the internal combustion engine 10 with oil 14, or during maintenance operations that require a change of oil 14.

Referring again to FIG. 2, the baffle component 58 and the cover component 40 may together define a capture cavity 62 between the first passage 56 and the second passage 60. As set forth in more detail below, the capture cavity 62 may be configured to capture a portion 64 of the oil 14, e.g., droplets, entrained within the quantity of air 32 during operation of the internal combustion engine 10 (FIG. 1) so that the portion 64 may not exit the oil fill apparatus 42 under conditions wherein the cap 46 (FIG. 1) does not seal the first end 44. As such, the capture cavity 62 may have a second volume (represented generally by shading 90 in FIG. 2) that is greater than the first volume 80. That is, the capture cavity 62 may be configured to retain the quantity of air 32 and the portion 64 of the oil 14, i.e., entrained oil droplets, within the internal combustion engine 10. In one non-limiting example, a difference between the first volume 80 and the second volume 90 may be from about 20 milliliters to about 60 milliliters, e.g., from about 20 milliliters to about 40 milliliters, or about 30 milliliters.

As such, referring to FIG. 2, during operation of the internal combustion engine 10, the oil fill apparatus 42 may be configured to direct the oil 14 from the channel 54 to the second passage 60 through the first passage 56 in the direction of arrow 100. In particular, the internal combustion engine 10 may be operated under conditions wherein the first end 44 is not sealed with the cap 46 (FIG. 1). For example, the cap 46 may be unseated from the first end 44 following maintenance activities for the internal combustion engine 10. During such operating conditions wherein the first end 44 is not sealed with the cap 46, the quantity of air 32 displaced during the aforementioned collective reciprocation of the plurality of pistons 24 (FIG. 1) within the respective plurality of cylinder bores 22 (FIG. 1) may carry the portion 64 of the oil 14 into the capture cavity 62 in the direction of arrow 110.

Subsequently, as described with continued reference to FIG. 2, the portion 64 may drain through the second passage 60 to the engine assembly 16 in the direction of arrow 100, e.g., via gravity. Therefore, the portion 64 may not enter the channel 54, e.g., through the first passage 56, and as such may not exit the channel 54 at the first end 44. That is, the portion 64 of the oil 14 may not escape from the oil containment system 12 through the first end 44 when the cap 46 is not mated to the oil fill apparatus 42.

Rather, the oil containment system 12 may contain the oil 14 within the capture cavity 62 (FIGS. 2 and 3) to minimize oil expulsion from the internal combustion engine 10 (FIG. 1). More specifically, the oil containment system 12 may prevent oil droplets from being expelled from the first end 44 (FIG. 2) of the oil fill apparatus 42 (FIG. 2) during reciprocation of the pistons 24 (FIG. 1). That is, referring again to FIG. 2, since the second volume 90 is greater than the first volume 80, any oil 14 carried to the capture cavity 62 during operation of the internal combustion engine 10 may remain within the capture cavity 62, and drain through the second passage 60 to thereby recirculate through the internal combustion engine 10. As such, airflow into and out of the engine assembly 16 may remain balanced, and the internal combustion engine 10 may operate efficiently. Therefore, the internal combustion engine 10 and oil containment system 12 reduce potential oil losses during operation of the internal combustion engine 10, e.g., for operating conditions wherein the first end 44 of the oil fill apparatus 42 is not sealed with the cap 46 (FIG. 1).

While the best modes for carrying out the disclosure have been described in detail, those familiar with the art to which this disclosure relates will recognize various alternative designs and embodiments for practicing the disclosure within the scope of the appended claims.

The invention claimed is:

1. An internal combustion engine comprising:

an engine assembly defining four cylinder bores therein;

four pistons each configured for reciprocating within a respective one of the four cylinder bores between a first position and a second position to thereby collectively displace a quantity of air having a first volume from the engine assembly;

an oil circulatable within the internal combustion engine; and an oil containment system attachable to the engine assembly and including:

a cover component including an oil fill apparatus configured for conducting the oil to the internal combustion engine, wherein the oil fill apparatus has:

a first end sealable with a cap;

a second end spaced apart from the first end along a central longitudinal axis; and an annular wall concentric with and extending along the central longitudinal axis, wherein the annular wall defines:

a first passage therethrough; and a channel extending through the cover component along the central longitudinal axis; and a baffle abutting the second end, wherein the baffle defines a second passage through the baffle such that the second passage is spaced apart from the channel;

wherein the oil fill apparatus is configured to direct the oil from the channel to the second passage through the first passage;

wherein the baffle and the cover component together define a capture cavity between the first passage and the second passage;

wherein the capture cavity has a second volume that is greater than the first volume;

wherein the second passage is disposed in fluid communication with the first passage.

2. The internal combustion engine of claim 1, wherein the annular wall defines the first passage through the second end.

3. The internal combustion engine of claim 1, wherein the second passage is spaced apart from the first passage.

4. The internal combustion engine of claim 1, wherein a difference between the first volume and the second volume is from 20 milliliters to 60 milliliters.

5. The internal combustion engine of claim 1, wherein the first end is not sealed with the cap.

6. The internal combustion engine of claim 5, wherein the quantity of air carries a portion of the oil into the capture cavity, and further wherein the portion drains through the second passage to the engine assembly.

7. An internal combustion engine comprising:

an engine assembly defining four cylinder bores therein;

four pistons each configured for reciprocating within a respective one of the four cylinder bores between a first position and a second position to thereby collectively displace a quantity of air having a first volume from the engine assembly;

an oil circulatable within the internal combustion engine; and an oil containment system attachable to the engine assembly and including:

a cover component including an oil fill apparatus configured for conducting the oil to the internal combustion engine, wherein the oil fill apparatus has:

a first end sealable with a cap;

a second end spaced apart from the first end along a central longitudinal axis; and an annular wall concentric with and extending along the central longitudinal axis, wherein the annular wall defines:

a first passage therethrough; and a channel extending through the cover component along the central longitudinal axis; and a baffle abutting the second end, wherein the baffle defines a second passage through the baffle such that the second passage is spaced apart from the channel;

wherein the oil fill apparatus is configured to direct the oil from the channel to the second passage through the first passage;

wherein the baffle and the cover component together define a capture cavity between the first passage and the second passage;

wherein the capture cavity has a second volume that is greater than the first volume.

8. The internal combustion engine of claim 7, wherein the first end is not sealed with the cap.

9. The internal combustion engine of claim 8, wherein the quantity of air carries a portion of the oil into the capture cavity, and further wherein the portion subsequently drains through the second passage to the engine assembly.

10. The internal combustion engine of claim 9, wherein the portion does not exit the channel at the first end.

11. An oil containment system for an internal combustion engine, the oil containment system comprising:

a cover component including an oil fill apparatus configured for conducting an oil to the internal combustion engine, wherein the oil fill apparatus has:

a first end sealable with a cap;

a second end spaced apart from the first end along a central longitudinal axis; and an annular wall concentric with and extending along the central longitudinal axis, wherein the annular wall defines:

a first passage therethrough; and a channel extending through the cover component along the central longitudinal axis; and a baffle abutting the second end, wherein the baffle defines a second passage through the baffle such that the second passage is spaced apart from the channel;

wherein the oil fill apparatus is configured to direct the oil from the channel to the second passage through the first passage.

12. The oil containment system of claim 11, wherein the baffle seals the channel at the second end, and further wherein the baffle does not define any opening therethrough that is disposed between the central longitudinal axis and the annular wall.

13. The oil containment system of claim 11, wherein the first passage is configured to drain from 130 milliliters/second to 160 milliliters/second of the oil therethrough.

14. The oil containment system of claim 13, wherein the second passage is configured to drain from 130 milliliters/second to 160 milliliters/second of the oil therethrough.

* * * * *